US007360534B2

(12) United States Patent
Krupp

(10) Patent No.: US 7,360,534 B2
(45) Date of Patent: Apr. 22, 2008

(54) HEATED REPLACEMENT AIR SYSTEM FOR COMMERCIAL APPLICATIONS

(75) Inventor: David Krupp, Hiram, GA (US)

(73) Assignee: Supplier Support International Inc., Hiram, GA (US)

( * ) Notice: Subject to any disclaimer, the term of this patent is extended or adjusted under 35 U.S.C. 154(b) by 26 days.

(21) Appl. No.: 11/088,664

(22) Filed: Mar. 24, 2005

(65) Prior Publication Data

US 2005/0229921 A1 Oct. 20, 2005

Related U.S. Application Data

(60) Provisional application No. 60/556,097, filed on Mar. 25, 2004.

(51) Int. Cl.
*F24H 3/02* (2006.01)

(52) U.S. Cl. ..... 126/110 A; 126/110 R; 126/116 A; 126/289

(58) Field of Classification Search ..... 126/110 R, 126/116 R, 116 A, 110 A, 289, 290
See application file for complete search history.

(56) References Cited

U.S. PATENT DOCUMENTS 4,402,302 A * 9/1983 Westelaken ..... 126/117
4,670,994 A * 6/1987 Takata et al. ..... 34/497
4,738,283 A * 4/1988 Shirai et al. ..... 137/624.11
5,108,284 A * 4/1992 Gruswitz ..... 431/286
6,129,285 A * 10/2000 Schafka ..... 236/44 C

* cited by examiner

*Primary Examiner*—Alfred Basichas
(74) *Attorney, Agent, or Firm*—MacMillan, Sobanski & Todd, LLC

(57) ABSTRACT

Apparatus and a method for providing heated replacement air to a paint spray booth or other commercial process which requires heated make-up air to replace exhausted air. A blower draws outside air through a filter and an injection chamber prior to delivering the air to the process. Hot gases from a burner are injected into the injection chamber and mixed with the replacement air to adjust the temperature of the replacement air. The burner uses combustion air which is separate from the replacement air. The flow rate of the exhaust air and the replacement air can be adjusted to meet changing needs of the process. The BTU output from the burner is adjusted to maintain a desired replacement air temperature.

6 Claims, 5 Drawing Sheets

HEATED REPLACEMENT AIR SYSTEM FOR COMMERCIAL APPLICATIONS

CROSS-REFERENCE TO RELATED APPLICATIONS

Applicants claim priority to U.S. Provisional Patent Application Ser. No. 60/556,097 filed Mar. 25, 2004.

STATEMENT REGARDING FEDERALLY SPONSORED RESEARCH OR DEVELOPMENT

Not Applicable.

TECHNICAL FIELD

The invention relates to a system for providing heated replacement air to a commercial or industrial process, such as to a paint spray booth.

BACKGROUND OF THE INVENTION

The process of applying atomized liquid coatings and adhesives generates potentially dangerous gaseous and particulate byproducts that are controlled or managed by confining them in an enclosure known as a spray booth and conveying them away from the process by entwining them in a moving air stream. This exhaust air stream typically passes through one or more stages of filtration to remove the particulates before the gaseous or vaporous byproducts are exhausted into the atmosphere. The volume of the exhaust air stream varies according to the size of the spray booth and may range, for example, from 3,000 cubic feet per minute (CFM) to more than 50,000 CFM. This equates to 30 to 150 lineal feet per minute within the spray booth in the direction of air flow. Provision may be made to replace the exhausted air volume.

Since most coating processes are vulnerable to quality rejects caused by dirt or other foreign airborne objects, prudent finishing process operators equip their facilities with air make-up unit. Air make-up units have a three fold function. First, they supply the process with the required replacement air. Second, they filter the replacement air. Third, they heat or condition it. An air make-up unit may be directly coupled to the spray booth or it may dump replacement air to the area surrounding the booth. Air make-up units are designed to include a heat source with sufficient thermal capacity to warm the volume of replacement air to the desired temperature on the anticipated coldest day. Typically, a fan or blower in the air make-up unit pushes or pulls the entire replacement air stream through a complex assembly that includes filters, dampers, and a heat source which is usually a gas burner.

Historically, environmental and worker health and safety regulations have empirically established minimum air velocities for spray booths. The overwhelming majority of installed spray booths are equipped with fixed speed exhaust fans or blowers. While exhaust air velocities change as the particulate filtration system loads, the pressure drop increase across the filtration system is usually limited to 0.5 inches of water column and produces a corresponding reduction in exhaust air volume in the range of 20%. Since the spray booth exhaust air volume is essentially fixed in any given installation, the volume of air the associated air make-up unit is required to provide also is fixed. Hence, the air make-up unit like the spray booth is usually equipped with a fixed speed fan or blower. In addition, the gas burner's operating efficiency is dependent on maintaining a predetermined air velocity through the burner mechanism. This precludes making significant changes to a given air make-up units delivered air volume without mechanically reconfirming the unit.

The attempts of placing a premix burner in the air stream in the early days of air replacement technology was short lived because the panel fans that were used were loud and could not handle the static loads of the supply plenum filters. Once the capability of the blower with the ability to handle additional static was introduced the most effective method for air replacement was established as the paradigm. Direct fired incline burners with associated profile plates that adjust the airflow across the burner proved to be the most efficient technology. These profile plates were first considered as fixed, as was the airflow through the unit. With changes in technology these profile plates have now become adjustable and the range of acceptable airflow across the burner has been increased.

In a traditional air make-up unit system, all of the replacement air is drawn across the burner assembly and any change in the delivered air volume will change the burner's air supply. This causes it to operate under less than optimum conditions. For this reason, traditional air make-up units are designed with fixed speed fans. Any reductions in delivered air volume are usually accomplished by partially closing a damper on the output of the air makeup unit (AM) to reduce the output volume or changing the speed of the blower with a variable frequency drive (VFD). A VFD adjusts the rotational speed of the fan motor to keep the ventilation system balanced. The cost to apply a VFD to control the motor for the unit with an in-line burner is significant because a larger motor size is needed for a system with an in-line burner due to the higher static load.

In an enclosed booth system, the air make-up unit discharges directly into the process within the booth. Based upon the assumption the air make-up unit operates at a fixed speed, the exhaust fan speed is varied as required to keep the booth balanced. Prior to the advent of electronic VFD units, a damper was placed in the exhaust stack. This damper added an adjustable static load to the fan. The damper was reduced as the overspray arresting filters loaded to maintain a constant air velocity through the booth. The range of actual air velocity changes under this or other schemes is limited.

Unfortunately, the resulting somewhat arbitrarily established, fixed volume air flow found in a typical spray booth system is not the optimum environment for efficiently applying a consistent high quality finish. Significant process economies, as well as improvements in the quality of the applied finish, can be achieved by reducing the air velocity in any given spray booth. A few astute finishing process owners have "tuned" their finishing process by adjusting the exhaust air volume of individual spray booths and making corresponding adjustments in the volume of replacement air delivered by the associated air make-up unit as well as the necessary mechanical changes to the air make-up units configuration. However, no one has designed an air make-up unit/spray booth system that can be mass produced, yet economically facilitate the tuning of individual installations to the precise needs of their respective finishing processes while simultaneously maintaining optimum air make-up unit operation.

In prior art spray booths, replacement air flow is either on or off because the effort required to vary its volume was complex and time consuming. The burner required a fixed combustion air velocity to achieve the necessary clean burn characteristics and therefore the overall replacement air volume couldn't be changed.

BRIEF SUMMARY OF THE INVENTION

The invention is directed to a direct gas fired heat source arrangement for air replacement or make-up units used in conjunction with spray booths and other industrial and commercial processes. The invention permits the replacement air volume to be varied over a wide range without compromising the integrity of the burner's combustion process and without requiring the expensive and somewhat tedious mechanical reconfirmation of the burner assembly. The invention utilizes a plurality of smaller burners positioned outside of the primary replacement air passage. The burners are operated to inject a controlled amount of heat into the primary replacement air passage to control the temperature of replacement air flowing through the passage. Each burner is individually configured in such a manner that it is always supplied with the necessary volume of air to insure complete combustion. When coupled with a modified spray booth and the appropriate controls, this invention allows the exhaust air flow rate and total volume to be optimized for the finishing process it protects, thereby increasing the process' coating application transfer efficiency, decreasing the emission of volatile organic compounds (VOC's) and particulates, increasing the quality of the applied finish, and significantly reducing the process operating cost. The invention provides the production economics associated with the manufacture of standard equipment packages while simultaneously enabling individual finishers to customize their air make-up unit—spray booth systems to the processes ventilation requirements solely by programming system controls.

Similar air handling systems are used to replace the significant quantities of process air exhausted to control the potentially hazardous build-up of gaseous and/or particulate emissions generated by other mid-sized and large commercial and industrial processes including, but not limited to wood working dust collection, welding fume collection, fiberglass reinforced plastic lay-up, sandblasting, commercial/industrial dry cleaning and cooking. The invention offers substantial process and economic benefits in these applications.

The invention allows the replacement air units to be thought of as modular components, not part of a unit that is shipped to the job site on a flatted truck. Processes that require very clean air now have the ability to have the filtration system designed specific to the application and not to be always contained within the confines of the AMU. The balance problem that existed when a single blower had to push air down different interconnecting duct work sections can now be better controlled by decentralized distribution fans that can have their speeds adjusted via the drive pulleys at start-up. This can achieve the desired balance, or the motors can be operated with variable speed drives (VFD's) which would better address the changes in static loads caused by filter loading.

The air replacement system of the invention can produce significant energy savings that are not possible with current systems. Although the cost of the self contained burner is greater than the simple in-line burner, the ability to let the process have less restrictive limits with regard to the volume of air required and to allow the process to demand only the volume that is required is a feature of the invention. Efficiencies that can now be gained by altering the air volume will produce significant savings in energy costs.

The replacement air system of the invention improves the overall efficiency and effectiveness of a process which consumes high levels of fossil fuels to reduce the energy cost for those who use the system. It also reduces emissions from burning excessive amounts of fossil fuels. The system is unique because it allows optimization of air being consumed by the spray booth or other process that contaminates the air, thereby opening a new concept to improve efficiency. It has been thought that no improvement could be made to the direct fired burner since all the heat goes into the air. However, with the invention the volume of air being consumed can be adjusted, which has a direct relationship to the overall fuel consumption.

Various objects and advantages of the invention will become apparent from the following detailed description of the invention and the accompanying drawings.

DETAILED DESCRIPTION OF THE INVENTION

The invention is directed to a heated replacement air system for an industrial or commercial process, and to apparatus which allows for the independent adjustability of the replacement air volume flow and the BTU energy applied to that air volume flow. The system is described herein specifically for use with industrial and commercial spray paint booths. However, the system also can be used with similar processes where varying the air volume being moved through the system and the temperature of the air during some periods of the process might allow the process to still function well within all process and safety requirements.

Figure 1:
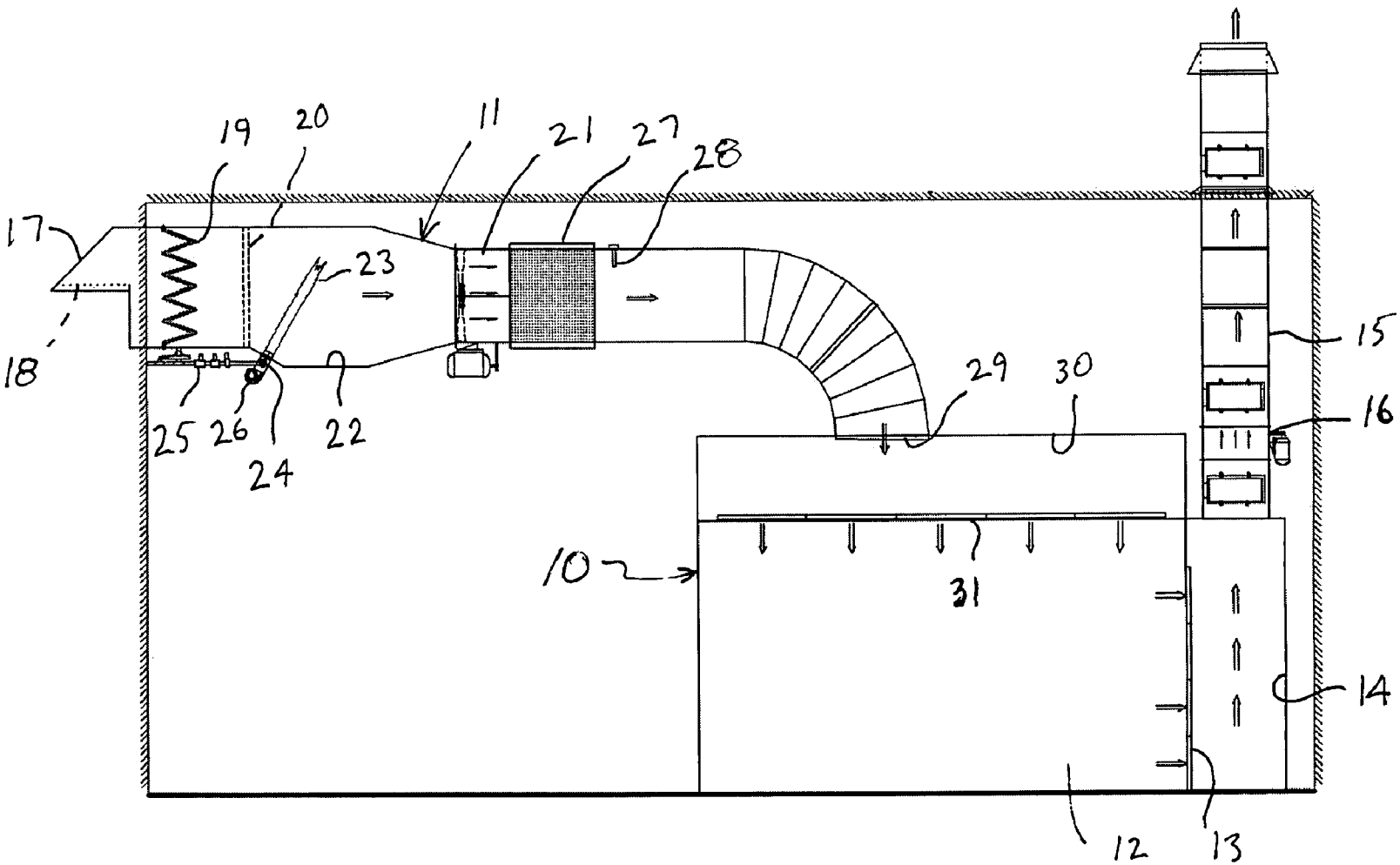
FIG. 1 is a diagrammatic view of a paint spray booth with a heated replacement air system according to one embodiment of the invention.

Turning to FIG. 1 of the drawings, an industrial paint spray booth 10 is shown incorporating a heated replacement air system 11 according to one embodiment of the invention. The spray booth 10 includes a work chamber 12 where objects are painted. The size of the chamber 12 will depend on the size of the objects which are painted. During painting, air and any entrained overspray particles and solvent fumes are exhausted through a filter 13 into a plenum 14. Exhaust air is withdrawn from the plenum 14 through an exhaust stack 15 by a motor driven exhaust fan 16. The apparatus for filtering and exhausting air from the spray booth 12 may be of any conventional type. For example, the filter 13 may be a simple as a replaceable glass fiber filter, or may be a water system which washes the exhaust air, or may include an advanced system for removing VOC's from the exhaust air.

Normally, the exhaust air is vented to the atmosphere outside of a building housing the spray booth 10. As air is exhausted from the building housing the spray booth 10, it is necessary to provide an equal amount of replacement air. If the ambient temperature is sufficiently high, the replacement air may be filtered ambient air drawn from outside of the building. However, on cooler days and especially in northern climates, it is necessary to heat the replacement air to the temperature required by the painting process.

The system 11 draws replacement air for the finishing process from the area surrounding the perimeter of the facility where the spray painting booth 10 or process contaminating the air is housed. Replacement air is drawn in through an air intake hood 17 or louvers which rejects rain. A screen 18 prevents birds and animals from entering the air intake hood. The replacement air is drawn through inlet filters 19 to remove airborne particulates that can cause defects in the uncured paint film should they be deposited thereon.

The outside air is separated from the process during times of non-operation by a motorized damper or shutter 20. The location of the damper or shutter 20 will be a function of where the building boundary is located with the desire to prevent outside air from entering the building perimeter when replacement air is not required. The controls for the replacement air system 11 will ensure the damper or shutter 20 is full open prior to the need for replacement air. Preferably, the damper or shutter 20 is of a type which keeps the static load on the system to a minimum during operation of the system 11.

A variable speed fan 21, preferably a tube axial distribution fan, draws normally cool to cold ambient air through the hood 17, the filter 19 and the damper or shutter 20 into a connecting injection chamber 22. In the chamber 22, the replacement air is blended with a stream of high temperature gas 23 which is injected into the replacement air flowing through the chamber 22 by a nozzle mix gas burner 24. Although only one burner 24 is illustrated, it will be appreciated that a number of burners may be provided to inject high temperature gas into the chamber 22 to provide the required BTU's. The BTU energy in the high temperature gas 23 is controlled by a modulating gas valve 25. Combustion takes place in the gas burner 24. The gas burner 24 includes a blower 26 which supplies the combustion air and also produces sufficient pressure to inject the high temperature gas stream 23 into the chamber 22.

The variable speed distribution fan 21 pulls the replacement air through the injection chamber 22 to meet the air volume requirement of the spray booth 10. The distribution fan 21 also thoroughly mixes and blends the high temperature air 23 from the system burner(s) 24 before being discharged into the spray booth 10. A tube axial distribution fan 21 can be used with this invention because the static load placed on the system is within the operation parameters for a tube axial fan. However, the invention is not limited to its use and would function well with other forms of air moving devices.

An optional muffler 27 can be mounted after the distribution fan 21 to reduce the noise level. If the injection chamber 22 and the distribution fan 21 were to be located outside the building, the muffler would also add to the insulation factor of the interconnecting duct work. Due to the higher frequency noise generated by a tube axial fan, the noise from a tube axial fan is easier to attenuate than the noise generated from a blower.

If only one distribution fan 21 is used in the system 11, a temperature sensor 28 used for temperature control is located after the distribution fan. If desired, the distribution fan 21 can be moved to a location significantly remote from the burner 24 to improve the overall effectiveness of the air replacement system. This invention allows the distribution fan(s) 21 to be placed at or near one or more supply points 29 to a spray booth supply plenum 30 to better control the distribution of the air. The spray booth supply plenum 30 is connected through filters 31 to deliver clean, heated replacement air to the work area 12. The prior art technology forces a single blower to be located close to the burner because the area between the burner and the blower is under significant static load. This restriction forces the air to be pushed down the interconnecting duct work.

Figure 2:
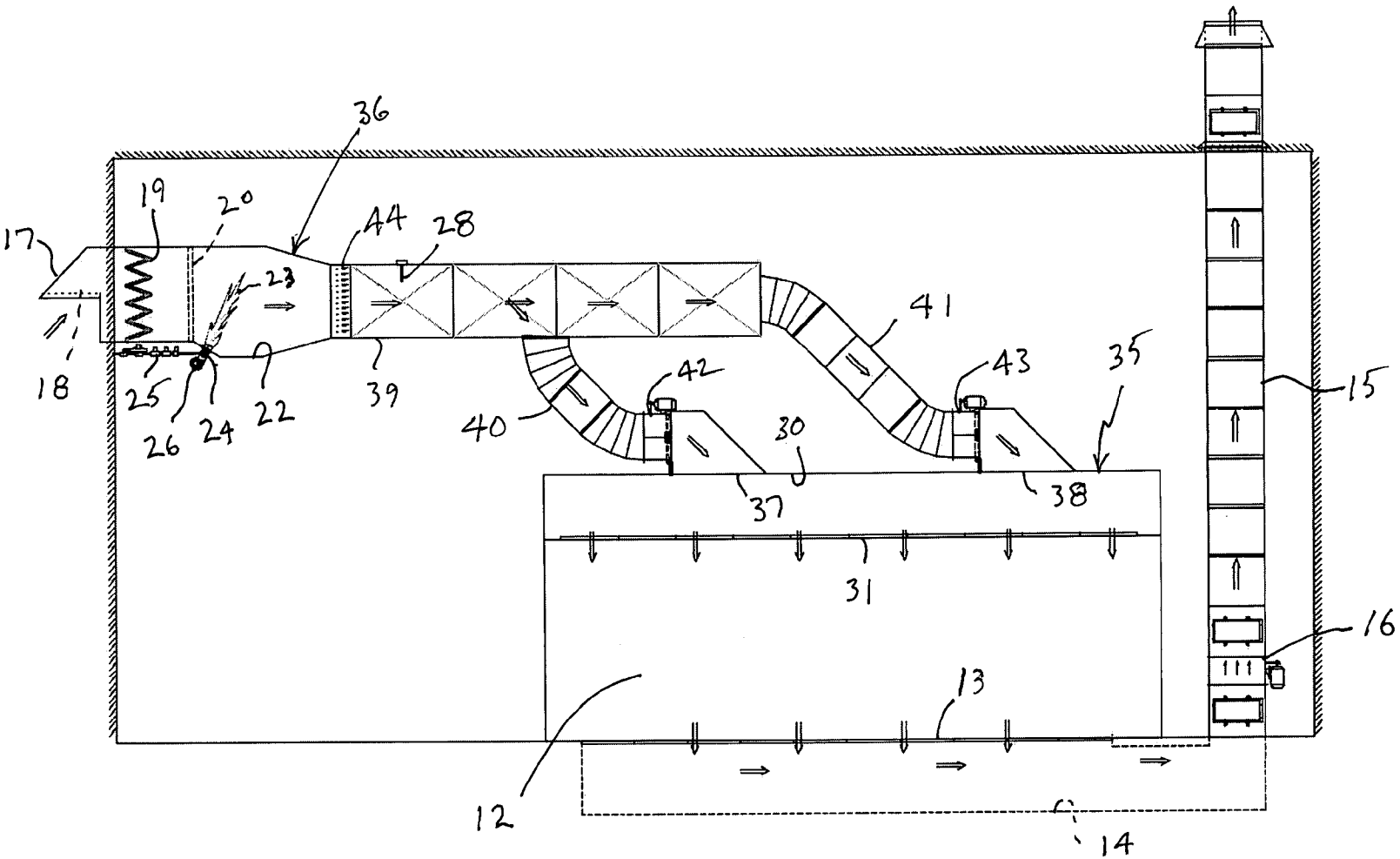
FIG. 2 is a diagrammatic view of a paint spray booth with a heated replacement air system according to a second embodiment of the invention.

FIG. 2 shows a down draft paint spray booth 35 incorporating a heated replacement air system 36 according to a modified embodiment of the invention. Components in the spray booth 35 and in the replacement air system 36 which are identical to those in FIG. 1 are labeled with the same reference numbers. The spray booth 35 is quite large, and may be in excess of 40 feet in length. Such a spray booth may be used, for example, for painting an automobile body. Due to the size of the supply plenum 30, replacement air is delivered through multiple points. Although two supply points 37 and 38 are illustrated, it will be understood that the number of supply points will depend on the spray booth size and air flow requirements.

When multiple discharge points from the air replacement system are required to service the spray booth replacement air flow requirements, the splitting of the air from a single centralized distribution fan such as the fan 21 in FIG. 1 can present problems. The replacement air system 36 has multiple distribution fans located at or near the discharge points to the supply plenum. The chamber 22 is connected to a duct 39, which is shown as splitting into two ducts 40 and 41. A fan 42 is connected between the duct 40 is shown mounted in the duct 40 near the discharge point 37 and a fan 43 is shown mounted in the duct 41 near the discharge point 38. When multiple distribution fans 42, 42 are located remote from the injection chamber 22, a mixing device 44 must be used to blend the air to provide a uniform temperature to the air flowing to the ducts 40 and 41. The temperature sensor 28 is mounted downstream of the mixing device 44. This mixing device 44 may be, for example, an arrangement of mixing fins designed to create turbulence to mix the air without adding significant static load to the system. Alternately, the mixing device 44 may be an additional fan which both blends the air and assists in addressing the static load of the system. While tube axial fans can be used with the system, the invention is not restricted to the use of any type air moving device.

There are also multiple options to inject heat utilizing this invention. There are different types of burners that can be applied to this concept. The embodiment of this invention includes the injection of BTU energy in the form of high temperature air from sources where the efficiency of the BTU injection will not be affected by the air volume through the injection chamber. The air for the self contained burner is a small percentage of the total volume of air. At designed maximum air volumes the burner for the typical system will inject less than 5% of the air volume. This air will be pulled from the area around the nozzle mix burner 24 by a self contained blower 26 that puts the optimum amount of air through the burner to achieve an efficient combustion.

The burners used to inject heat for the system also can be used with a heat exchanger to allow the system to be converted to an indirect fired unit to prevent any byproducts of combustion to be passed into the air stream. This allows the system to recirculate air in a facility for comfort heat. The conversion from a direct fired heat mode to an indirect heat mode may be needed when the area being service by the system is a multi-purposed area such as a tech center or a demonstration area that needs comfort heat at times and also houses processes that at times require air to be exhausted from the facility. Rather than having multiple heating systems the system can be adapted to perform both heating modes. Due to the efficiency of direct heat and the increased capability for heat rise with a direct fire burner in the system the conversion capability has significant benefits.

Figure 3:
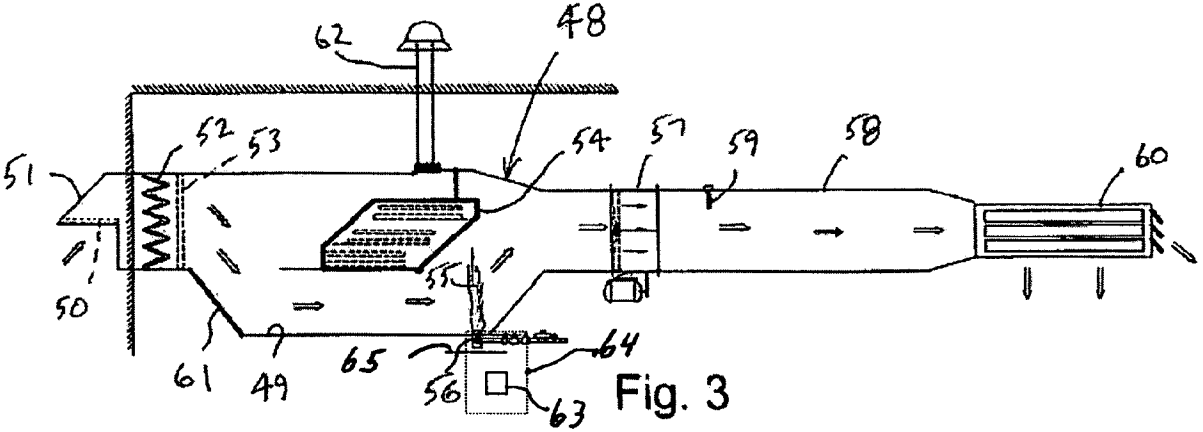
FIG. 3 is a diagrammatic view of a dual mode heated replacement air system according to a further embodiment of the invention, showing the system operating in a direct fire operation.
Figure 4:
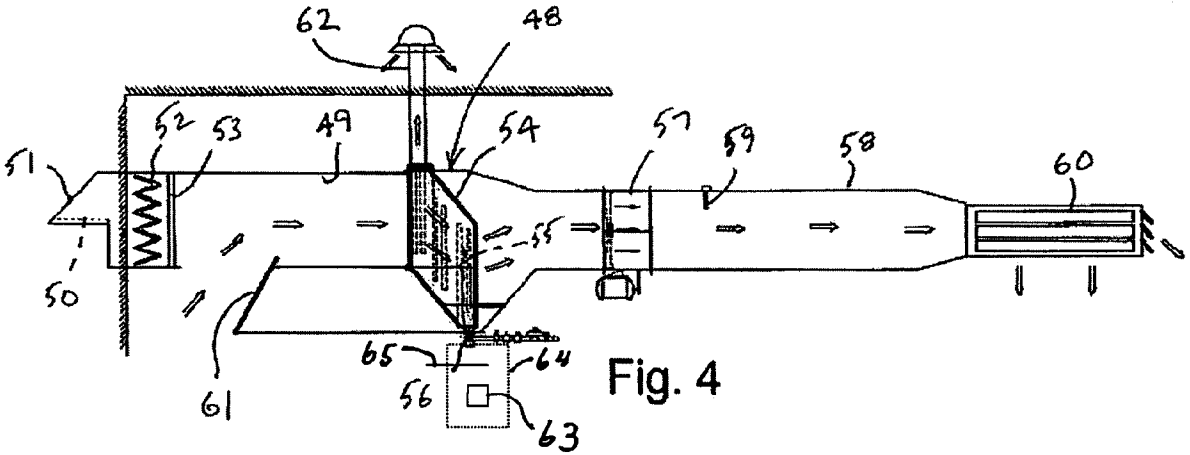
FIG. 4 is a diagrammatic view of the dual mode heated replacement air system of Fig., showing the system operating in an indirect heat operation.

FIGS. 3 and 4 show a dual mode heated replacement air system 48 according to a modified embodiment of the invention. The system 48 is shown operated in a direct fired mode in FIG. 3 and is shown operated in an indirect heat mode in FIG. 4. The system 48 includes a injection chamber 49 through which replacement air flows. In the direct fire mode shown in FIG. 3, fresh outside air is drawn through a screen 50 in a hood 51, through a filter 52 and through an open damper or shutter 53 into the chamber 49. An indirect heat exchanger 54 is located in a retracted position, allowing the replacement air to flow below the indirect heat exchanger 54 where it is impinged by a hot gaseous jet 55 from a burner 56. The heated replacement air is then forced by a fan 57 into a duct 58. The fan 57 mixes or blends the air before it flows past a temperature sensor 59 before it is delivered through a plenum chamber 60 to a spray booth or other process requiring heated replacement air.

In the indirect heat mode shown in FIG. 4, the indirect heat exchanger 54 is moved to extend across the chamber 49 and the damper or shutter 53 is closed to prevent outside air from entering the building. A damper 61 is moved to a position which allows ambient air from inside the building to be drawn into the chamber 49. The fan 57 draws the inside air through the indirect heat exchanger 54 where it is heated, and delivers the heated air to the duct 58. The hot gaseous jet 55 from the burner 56 is directed into the heat exchanger 54 where it indirectly heats the replacement air flow. The gaseous jet 55 is then exhausted through a vent stack 62 to a location outside of the building. In the indirect heat mode combustion production products from the burner 56 do not enter the spray booth. It will be appreciated that the indirect heat mode may be operated for heating either interior air or exterior air, depending on the position of the damper 61.

If the burner 56 for the system is located out doors the blower 63 that supplies combustion air to the burner 56 is enclosed to protect it from the elements. The combustion air required for the burners 56 used in the system is filtered separately or the enclosure 64 that houses the blower 63 that forces the heat into the air stream is connected to the air inlet chamber after the filters 65.

Preferably, the burner used to inject high temperature air into the replacement air stream is a self contain burner with a separate blower having the capability of manage flame control as part of the self contained system. The preferred burner is a known nozzle-mix burner with a modulating gas valve. These burners are capable of producing as much as 1 million BTU per foot and work well under most conditions.

Figure 5:
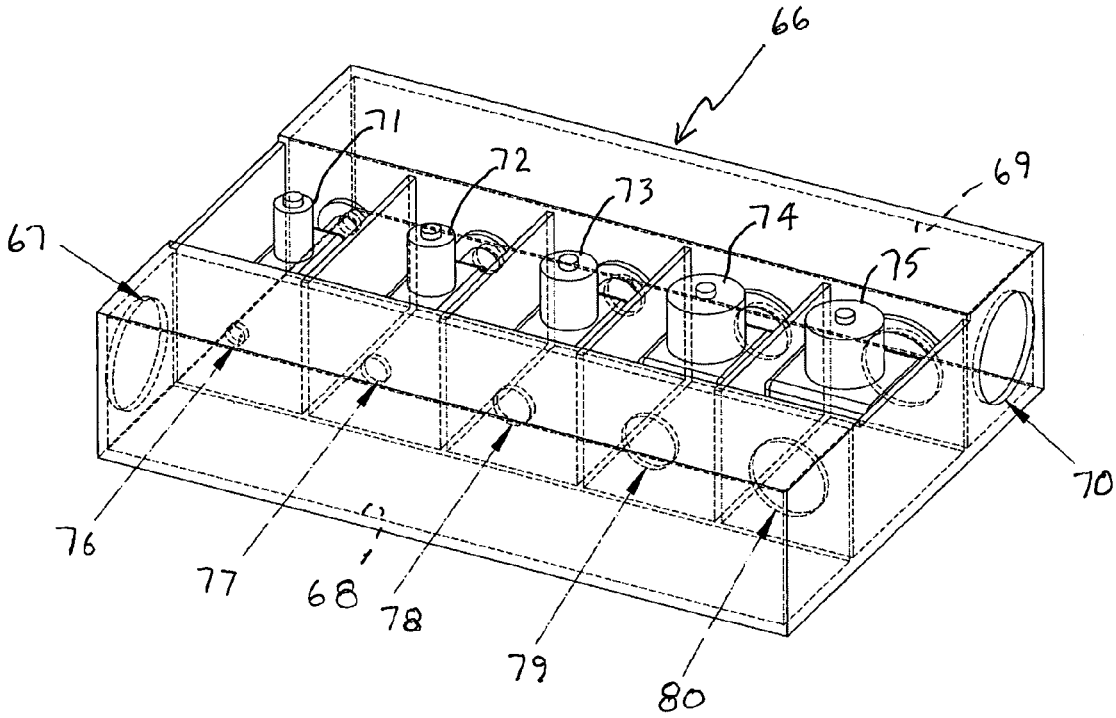
FIG. 5 is a perspective view of a multi-port digital gas flow control valve.

The nozzle-mix burner also can be used with a digital gas control valve 66 of the type shown in FIG. 5. The valve 66 has a gas inlet port 67 which connects to an inlet manifold 68 and a gas outlet manifold 69 which connects to a gas outlet port 70. The gas control valve 66 has a plurality of individual open/closed solenoid operated gas valves connected between the inlet manifold 68 and the outlet manifold 69, with five valves 71-75 illustrated. A calibrated orifice is positioned in each flow path between the inlet manifold 68 and the outlet manifold 69. The orifices control the gas flow between the manifolds 68 and 69 for each of the valves 71-75. An orifice 76 is shown for limiting the gas flow when the valve 71 is opened; an orifice 77 is shown for limiting the gas flow when the valve 72 is opened; and an orifice 78 is shown for limiting the gas flow when the valve 73 is opened; an orifice 79 is shown for limiting the gas flow when the valve 74 is opened; and an orifice 80 is shown for limiting the gas flow when the valve 75 is opened.

The orifices 76-80 may be of uniform size. Alternately, the orifices 76-80 may be calibrated to provide different gas flow rates to control the burner's BTU output. For example, the orifice 76 may be calibrated to provide a 50,000 BTU burner output, the orifice 77 may be calibrated to provide a 100,000 BTU burner output, the orifice 78 may be calibrated to provide a 200,000 BTU burner output, the orifice 79 may be calibrated to provide a 400,000 BTU burner output, and the orifice 80 may be calibrated to provide an 800,000 BTU burner output. By selectively opening one or more of the valves 71-71, the burner output may be controlled in 50,000 BTU increments to inject between 50,000 BTU's and 1,550,000 BTU's of heat to the replacement air flow. Substitution of the multi-port digital gas control valve 66 in place of the traditional analog gas valve in the gas line supplying the burner allows a single burner to provide quick response to changes in air volume to precisely maintain the set point temperature of replacement air irrespective of the temperature of the air being drawn into the system's inlet.

The multi-port digital gas control valve 66 enables the system to quickly and independently adjust the temperature during changes in air volume by pulling the system out of a closed-loop control and calculating the amount of gas that is needed to reach the set point temperature based upon the incoming air temperature and volume flow rate. The initial calculated setting may be the starting point for the closed loop system when control is given back to make minor adjustments. The snap action of the multi-port digital gas control valve 66 allows the volume of replacement air to change quickly without the significant hysteresis that is caused by the proportional integral derivative (PID) input device loops of the traditional analog method. The traditional analog method limits the transition speeds that can be used when changing the air volume to prevent out of tolerance temperature swings during times of ramp up and ramp down in air volume.

Figure 6:
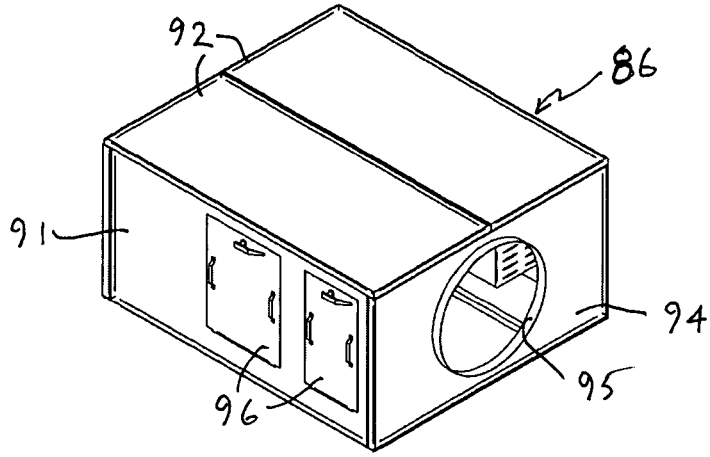
FIG. 6 is a perspective view of a multi-burner apparatus for injecting heat into a flow of replacement air for an industrial or commercial process such as a paint spray booth.
Figure 7:
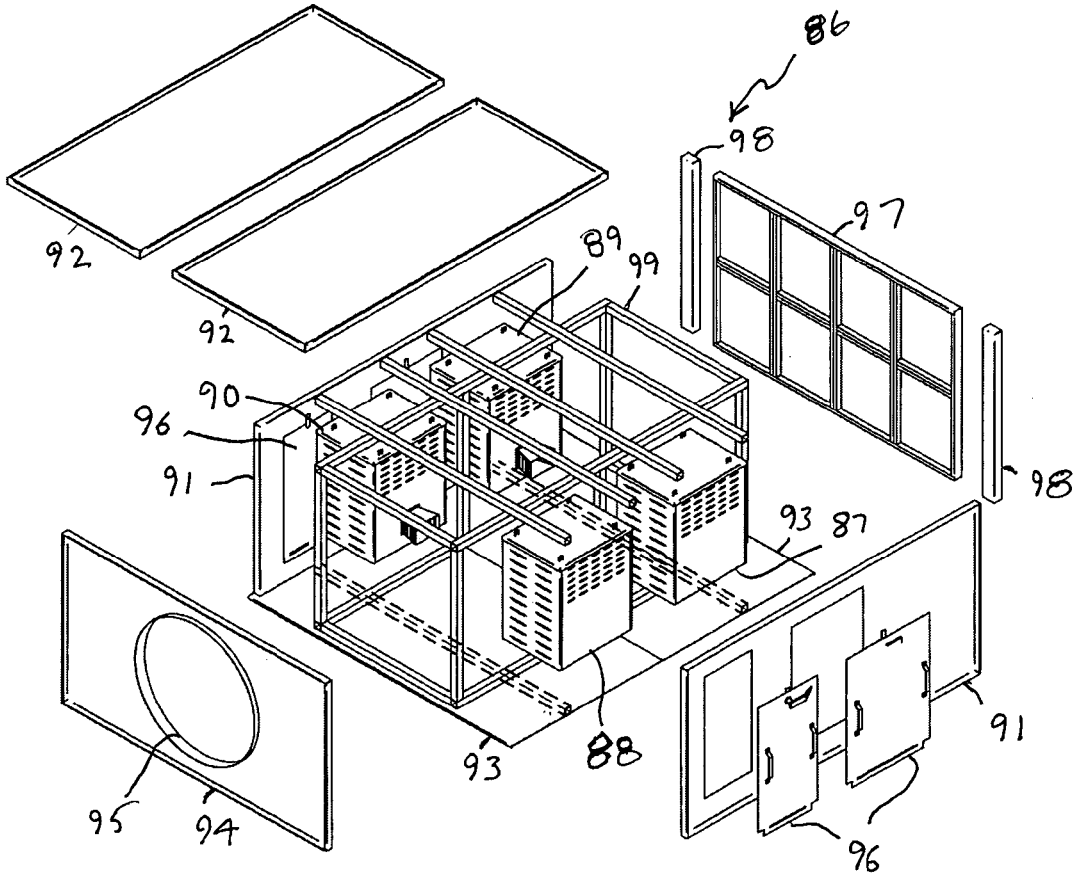
FIG. 7 is an exploded perspective view of the apparatus of FIG. 6.

FIGS. 6 and 7 show details of an exemplary self contained multi-burner unit 86 for injecting heat into a flow of replacement air to a paint spray booth or other process which requires heated replacement air. The unit 86 is designed as a stand alone unit which can be shipped as a unit separate from a spray booth to an installation site. The unit 86 has four heat injector burner units 87-90 mounted within a housing formed, for example, from sheet metal side panels 91, top panels 92, bottom panels 93 and an end panel 94. The end panel 94 has a replacement air outlet opening 95 which is adapted to be connected to ducts leading to the spray booth (not shown). One or more fans (not shown) for drawing replacement air through the unit 86 is mounted in the spray booth ducts. The side panels 91 are shown as including service doors 96 for providing access to the burner units 87-90. A replaceable inlet air filter 97 is mounted in channels 98 to cover the end of the unit 86 opposite the outlet opening 95. The unit 86 also includes a frame structure 99 for supporting the burner units 87-90 and the panels 91-94.

The system may have multiple burners of the same size or of different sizes and of different types to inject heat into the replacement air. Self contained premix, nozzle mix and venturi burners along with other known burners that meet the specification of being self contained units also can be used in the system. In actual practice the number and size of the individual burners depends upon the maximum anticipated heat requirement of the process the system is supporting.

Multiple nozzle mix burners can be used where a fixed BTU rate is provided when the demand for heat was greatest and the smaller burner is modulated to address fine temperature adjustments. The turn-down ratio for the nozzle mix burner is rated at 40:1 so having multiple units where larger burners are required will allow improved temperature control when low levels of BTU energy are required.

For example in very frigid climates that have sub zero daytime temperatures a typical 33,000 cam unit will have a 4 million BTU burner to produce a 110 degree F. Heat rise which will bring the −20° F. Air up to 90° F. The minimum BTU level that can be supported by the burner is 100,000 BTU (4 million/40). At 33,000 cam the temperature rise of 2.8° F. But if the air volume is reduce to 25% that heat rise would be 11.2° F. This is most noticeable when the outside temperatures is more moderate. With an outside temperature of 67° F. The minimum air temperature supplied to the process with the burner at its lowest setting becomes 78.2° F. (67°+11.2°). The turn down ratio of the in-line direct fired burners are rated at 30:1 so the low level sensitivity is worse.

If the tolerance on air temperature for the process is tight, the capability of the system to develop finer resolution can be improved by providing multiple nozzle mix burners. By incorporating dual 2 million BTU burners where one with a simple on/off control (the "drone") is engaged at full output once the maximum of the modulated unit has reached its maximum output. Better control may be achieved if the drone burner is slightly smaller than the modulated burner to allow for fine tuning once the drone burner is turned on.

Other self contained direct fired burners can be used if they produce a clean and efficient combustion, so long as the combustion byproducts are not incompatible with the process and the personnel involved. A 225,000 BTU venturi burner is not the preferred burner since it does not have a very significant turn down ratio (2:1 vs. 40:1 for the nozzle mix burner) and the injected air volume injected is triple the air volume injected by a nozzle mix burner. Multiple venturi style burners which inject heat into the main air stream also can be used. Instead of modulating them they can be turned on in stages based upon the need for heat which cause a stepped heat rise. The burners may be equal sized, or they may of differing sizes such as, but not limited to, a binary progression.

System controls can be as simple as a heated replacement air temperature sensor which controls the burner output and a differential pressure sensor to control the speed of the distribution fan. This is typical for a manually controlled system that operated as an air replacement unit which delivers a manually adjusted amount of air into a facility with a general dump distribution head to replace air being exhausted by various devices such as sanding benches, fume hoods, multiple small spray booths and any other process which exhaust air from the facility.

The system controls also can be a sophisticated software driven, microprocessor based system which monitors and controls a number of primary and ancillary process variables and is programmed to precisely deliver the right volume of clean, conditioned air, at the predetermined temperature. It can respond to the demand to replace the process air being exhausted by the spray booth or any other high volume air exhausting process.

A key to the efficiency of the system is its ability to vary the airflow through the system without changing the products of combustion. With this capability the spray booth is now able to control the volume and temperature of air being consumed over a wide range based upon the requirements of the process. Temperature conditioning is required on less volume of air and produces significant energy savings. The advances in technology to vary the speed of the fans and the increased cost of fuel have caused the system to become a practical approach to the replacement air process.

The system can have multiple modes of operation. Either the exhausted air volume or the replacement air volume can be set as the master. The exhaust air volume can be set as the master when the volume can be applied to the process elements which contaminate the air. The replacement air volume can be set as the master maximizing the air flow through the process given the variables in the replacement air system such as outside temperatures and limits in fuel available. This mode causes the exhausted air volume to become slave.

The most typical operating mode allows the process to dictate amount of air required. Changes in the volume of air can be triggered by the process variables or in response to the sources that contaminate the air. For example, the exhaust air flow can be increased while coatings are being applied to a workpiece and decreased when the coating operation is stopped or a predetermined time after the coating operation is stopped. Or, the exhaust air flow rate can be controlled in response to the level of VOC's in the spray booth air. While monitoring specific process variables and using these as drivers for safety interlocks and/or as the stimuli to adjust the overall replacement air flow, the system uses these inputs to automatically optimize the performance of the entire system including the process it is serving. The invention focuses upon the requirements of the process with regard to the safe and effective levels for each aspect of the process and develops methods to determine when those processes take place.

When looking at the painting process, typical modes are idle, peep, low speed paint, high speed paint, low temperature cure, high temperature cure and cool down. The most significant energy savings from the system over prior art systems is in the idle, peep, low speed paint and low temperature cure modes. A focus of the system is to allow a reduction in the total volume of air that is exhausted per day, which in turn reduces the energy needed to heat replacement air.

The idle mode is used to start the unit and to operate after a low temperature cure. The BTU's of heat delivered to the replacement air may be set, for example, to about 15-25% of the normal operating level. In the peep mode, the BTU's may be adjustable, for example, over a range of 25-40% of the normal operating level, and in the low temperature cure mode the BTU's may be adjustable, for example, in the range of 40-60%. It will be appreciated that the replacement air flow rate and the BTU's applied to the replacement air for different operating modes can be adjusted as needed.

In any climate that requires temperature or humidity controls, the benefits of the heat injector can be seen. When the cost of replacement air is not a factor due to temperate outside, the system will still have a benefit because the amount of air moved through the system, even without temperature conditioning, will have an affect upon the amount of electrical energy used. In these climates, the addition of an evaporative cooler option might prove to be a benefit. The option to cool the air by utilizing evaporative cooling panels is possible with the reduced static of the system. The same climates that need heat in the winter could use evaporative cooling in the summer. Evaporative cooling coils for dehumidifying and/or cooling the air can be placed immediately after the inlet filters and before the heat injector.

Commercial benefits of the different embodiments of the invention, provide one or more of the following:

Only as much make up air is supplied as the process actually needs. The unique design of the system enables it to deliver only as much replacement air as the process is actually discharging. Therefore, a single system can serve a facility equipped with multiple spray booths, economically responding to the varying load as individual spray booths are brought on-line or taken off-line without compromising the system's combustion efficiency of the system and without either over or under ventilating the process.

Cold start conditions are nearly eliminated. Burner safety regulations require the presence of combustion air before the fuel is turn on. Since traditional direct fired air make-up units use the same air mover to supply both the combustion air and the replacement air, they require a flow of cold air at full volume before the burners can be ignited. When the incoming replacement air temperature is low, this results in significant volumes of uncomfortable cold air being dumped into the process area every time the system is started. To avoid this start-up chill, operating personnel keep their air make-up units operating during down periods, thereby wasting significant quantities of power and fuel. The combustion air, which is typically 10% or less of the replacement air volume, is separate from the replacement air. The primary air mover does not need to be energized until the burner is fired and producing warm replacement air.

Electrical power consumption is reduced. Since the burners are located outside the primary air passage, the internal pressure drop is a fraction of the pressure drop of a traditional direct fired air make-up unit. The system can deliver a comparable volume of air with significantly less (approximately 30-50% less) horsepower, resulting in a significant savings in electrical power consumption.

A typical 15,000 CFM prior art air make-up unit requires a 10 HP. Motor. Due to its unrestricted air passage, a system according to the invention of the same capacity only requires a 5 HP. Motor to move the air plus a fractional horsepower motor to provide combustion air for each burner. The average annual savings in electrical power due to the reduction in motor horsepower alone can exceed 40%.

Energy consumption during non-spray operations is significantly reduced. In installations where a single spray booth has a dedicated air make-up unit, the variable volume air supply makes it possible to add a properly sized, variable frequency motor controller to the spray booth's exhaust fan. This allows the entire air replacement/ventilating system to be programmed to exhaust the normal required volume of exhaust air during the spraying and flash-off operations. The exhaust air volume can be stepped down to a substantially lower level during non-regulated activities such as the time when the parts are being prepared for painting, while the paint is being prepared, while the equipment is being set-up or maintained, during break periods and during the cure cycle, thereby achieving significant savings in both electrical power and heating fuel.

Better temperature control when outside temperatures are moderate. While a traditional constant volume air mane-up unit typically includes a modulated gas valve, the inherent design of the air make-up unit does not allow for a good gas flow at low settings. Units sized to provide the typical 70° or 90° F. Temperature raise required in colder locations have difficulty maintaining the desired output temperature when the outside temperature is more moderate and the unit has to repeatedly toggle on and off. Consequently, the replacement air tends to be either too hot or too cold. The multiple burner option of the invention and its focus to treat the BTU energy separate from the air volume required for the process allows a better adjustment irrespective of the temperature of the incoming air.

Coating transfer efficiency can be safely maximized by optimizing air flow for each discrete finishing operation conducted within a spray booth. The system enables the spray booth ventilation to be tuned to safely maximize the overall transfer efficiency for the finishing process. The savings associated with the reduction in coating consumption associated with a 10% increase in the finishing transfer efficiency can conservatively exceed $10,000 per year for each production spray booth.

The control system for such a system or spray booth system can be equipped with VIC and/or LE sensors that will automatically increase the exhaust air flow if it detects the higher than desired concentrations of gaseous and/or particulates within the process. When the concentrations decrease or when the finishing process is taken off-line, the exhaust air volume can be automatically reduced.

Airflow can be optimized at any given temperature setting. When the incoming air temperature drops below its designed temperature rise range, a traditional air make-up unit system will deliver replacement air at a temperature below the desired process set point. Under these circumstances the thermal load of the fixed air delivery volume is beyond the burner's capacity. Users have two options, neither of which is good. They can suspend operations until the outdoor temperature moderates, or they can operate with the process below the desired temperature. The system has the ability to produce the maximum air volume at the set point without compromising the burner's combustion efficiency.

Some traditional air make-up units are built with a dual air velocity feature to facilitate spraying and curing in a single location. In the spraying mode the air make-up unit delivers its rated airflow at predetermined temperature, usually 70° F. In the curing mode the air flow rate is reduced to a fraction of the spraying, while the temperature set point will be proportionally higher, typically in the 125-150° F. Range. The clean burn characteristics are lost at this point because the required airflow across the burner has been significantly reduced. A colder than normal ambient temperature can also be a problem in the curing mode even with the reduced air flow. The unit may have enough capacity for the painting process, but not enough capacity to achieve the desired cure temperature. The system can be programmed to reduce the airflow to a level within the unit's capacity to achieve the programmed cure temperature within the process area. Again, this can be done without jeopardizing the minimum airflow requirements of the burner.

The system's variable volume capability enables it to handle these out of tolerance situations well and provides process advantages that are not currently available. The system gives the operator the ability to control the curing cycle by further turning up the thermostat set point and simultaneously lowering the volume of process air or increasing the airflow at a reduced set point. The system provides the optimum control for flashing off and then curing sensitive waterborne coatings.

The design can facilitate automatic conversion between direct and indirect heat transfer. The system is ideally suited to processes that require large volumes of heated replacement air at times and require an indirect air heater recirculated heat source at other times. A typical application would be a plant or lab area with open face spray booths. In this situation the direct fired burner is used when the outside replacement air is required and the indirect fired unit is used when the exhaust dampers close to recycle the exhaust air within the process.

This unit also can be used in a continual state as a recirculated burner. It can be configured to operate in a direct fired mode allowing the process area to be quickly and efficiently heated then, when the area is nearly up to temperature and the burner is normally turned down, the system is switched to the indirect fired mode to isolate the process area from the buildup of harmful byproducts of combustion.

The system allows the process area to be brought up to temperature quickly by utilizing the high efficiency and the clean burn of the direct fired burner at its normal high gas flow. Once the space has reached the desired temperature, the burner controls can be programmed to be automatically turned down to reduce the air flow, and to automatically convert to an indirect heat source to maintain the temperature by injecting the heat into the process through a heat exchanger. This will prevent injecting any harmful combustion byproducts at the lower burner levels. This capability provides the advantages of both a direct and an indirect fired burner, while eliminating the disadvantages of each. The system's dual-mode option provides significant energy efficiency gains and eliminates the need to purchase dual heating systems with the expense of multiple building penetrations and gas lines.

The indirect option also allows the system to be used as a post-heater in a humidity controlled system. When humidity control is required, the system in the indirect heating mode can be added downstream of the cooling coils to act as a post-heater to bring the super chilled air back to the desired temperature set point. In the indirect heat mode, the burner combustion byproducts gases are isolated from the process air stream and can not add moisture to it.

During the heating season, the system operates in the direct fired mode. This is the most energy efficient mode and the direct fired combustion will increase the process air's humidity, reducing the amount of additional moisture required to bring it up to the required relative humidity level. The direct fired burner can be downstream of the cooling coils because any escaped gas from the cooling coils will not be exposed to the burner flame.

Overall reduction in capital costs. The system is significantly lighter than the comparable air make-up unit it replaces. Typically the electric motor is half the horsepower size of that of an equivalent sized traditional unit. The air supply fan is correspondingly smaller than the traditional air make-up unit. The substantial weight of the traditional air make-up unit often requires the construction and installation of a costly steel reinforced supporting structure.

The modular nature of the system allows the replacement air unit to be broken into segments to provide greater flexibility in where components are located and sometimes eliminating the need to have an expensive crane to set it in place. This flexibility can also simplify duct work as well as make it more convenient to service.

Modularity facilitates combining with other process air condition technologies. The modular design of the system is adaptable for use with a variety of heat sources such as steam and the heat thrown off by environmental emissions abatement systems and thermal oxidizers. Heated air from these sources of energy can be injected into the air stream as the only source of BTU energy, or to augment a gas fired burner. Since the heat source is not in the middle of the air stream, the system can safely and easily be coupled with an evaporative cooler, a dehumidification chiller or any other air conditioning device or system.

It will be appreciated that various modifications and changes may be made to the above described preferred embodiment of a heated replacement air system without departing from the scope of the following claims.

The invention claimed is:

1. Apparatus for supplying heated replacement air to a process in which air is exhausted, said apparatus comprising an air intake connected to an injection chamber from which a desired volume of replacement air flows to the process, a source of BTU energy positioned outside said injection chamber and configured to inject heated gas into said injection chamber;

at least one process fan configured to:

i) draw replacement air through said air intake and into said injection chamber, and ii) deliver a predetermined and adjustable volume of the heated replacement air to the process, wherein the volume of the heated replacement air does not affect the products of combustion of the BTU energy that is injected; and, an adjustable mode changing damper configured to be movable between a first position wherein replacement air from a first location is drawn by said at least one fan from said air intake into said injection chamber and a second position wherein air from a second location is drawn by said at least one fan into said injection chamber.

2. Apparatus for supplying heated replacement air to a process in which air is exhausted, said apparatus comprising an air intake connected to an injection chamber for supplying a desired volume of replacement air to the process;

a source of BTU energy positioned outside said injection chamber and configured to inject heated gas into said injection chamber, at least one fan configured to:

i) draw replacement air through said air intake and into said injection chamber, II) mix the heated gas with the replacement air to blend the heated replacement air, and iii) deliver a predetermined and adjustable volume of the heated replacement air to the process, wherein the volume of the heated replacement air is substantially the same volume as the exhaust air from the process; and a mode changing damper having: i) a first position wherein replacement air from a first location is drawn by said at least one fan from said air intake into said injection chamber, and II) a second position wherein air from a second location is drawn by said at least one fan into said injection chamber across a movable indirect heat exchanger mounted in said injection chamber, said indirect heat exchanger being in said first position when said damper is in said first position and heated gas is injected directly into replacement air drawn through said injection chamber, and said indirect heat exchanger being in said second position when said damper is in said second position and heated gas flows through said indirect heat exchanger and replacement air is drawn through said injection chamber and is indirectly heated by said indirect heat exchanger.

3. Apparatus for supplying heated replacement air to a process, as set forth in claim 1, further including a mixing device located between said injection chamber and said at least one fan.

4. Apparatus for supplying heated replacement air to a process, as set forth in claim 2, and further including an indirect heat exchanger mounted in said injection chamber to move between first and second positions, wherein when said indirect heat exchanger is in said first position heated gas is injected directly into replacement air drawn through said injection chamber, and wherein when said indirect heat exchanger is in said second position heated gas flows through said indirect heat exchanger and replacement air drawn through said injection chamber and is indirectly heated by said indirect heat exchanger.

5. Apparatus for supplying heated replacement air to a process, as set forth in claim 4, and further including an adjustable intake damper mounted between said air intake and said injection chamber; said adjustable intake damper having a position permitting an unrestricted flow of air from the first location through said air intake when said mode changing damper is in its first position and said intake damper blocking air flow from the first location through said air intake when said mode changing damper is in its second position.

6. Apparatus for supplying heated replacement air to a process, as set forth in claim 5, and wherein said source of heated gas is a gas burner, said gas burner including a blower connected to develop a proper air-to-fuel ratio and blow hot combustion gases from said gas burner into said injection chamber thereby preventing a change in the volume of replacement air from affecting the products of combustion.

* * * * *